United States Patent [19]

Powell

[11] 4,220,936

[45] Sep. 2, 1980

[54] MANUALLY OPERATED GENERATOR CIRCUIT BREAKER

[75] Inventor: David B. Powell, Burlington, Conn.

[73] Assignee: General Electric Company, New York, N.Y.

[21] Appl. No.: 27,556

[22] Filed: Apr. 6, 1979

[51] Int. Cl.[3] ..... H01H 9/20

[52] U.S. Cl. ..... 335/166; 200/153 SC; 335/26

[58] Field of Search ..... 335/166, 26, 15, 17, 335/13, 68, 76, 160; 200/153 SC, 153 G

[56] References Cited

U.S. PATENT DOCUMENTS

| | | | |
|---|---|---|---|
| 3,343,109 | 9/1967 | Jencks et al. | 335/26 |
| 3,559,121 | 1/1971 | Powell et al. | 335/68 |
| 4,042,896 | 8/1977 | Powell et al. | 335/17 |
| 4,097,831 | 6/1978 | Jencks et al. | 335/166 |
| 4,128,750 | 12/1978 | Castonguay et al. | 200/153 SC |

*Primary Examiner*—Harold Broome

*Attorney, Agent, or Firm*—Robert A. Cahill; Walter C. Bernkopf; Philip L. Schlamp

[57] ABSTRACT

A manually operated mechanism of an industrial circuit breaker utilizes a hook to hold the movable contacts open against the bias of charged mechanism springs. Manual or closing solenoid initiated articulation of the hook releases the contacts for abrupt closure under the urgence of the discharging mechanism springs. An indicator appropriately positioned by the operating mechanism identifies the charged and discharged mechanism states.

12 Claims, 15 Drawing Figures

MANUALLY OPERATED GENERATOR CIRCUIT BREAKER

BACKGROUND AND OBJECTS OF THE INVENTION

In certain applications it is necessary to coordinate or synchronize the closure of a circuit breaker with the functioning of other electrical apparatus, such as generators. With the typical industrial circuit breaker, charging of its mechanism springs preparatory to closure of its contacts is achieved by articulation of a manual operating handle. Normally, it is impossible to predict with any degree of precision when, after the mechanism springs have become fully charged, the mechanism has reached the condition where the springs can discharge pursuant to powering the breaker movable contacts to their closed circuit positions in engaging relation with the breaker stationary contacts. For the traditional toggle-type breaker operating mechanism, this condition is reached when, during mechanism articulation, the line of action of the mechanism springs moves from one side to the other side of a particular toggle pivot point.

To provide rather precise control of the moment of closure of breaker contacts, a hook has been used to hold the breaker movable contacts in their open positions against the bias of the mechanism springs, despite the fact that the breaker mechanism has been articulated to its contact closure condition. When contact closure is desired, the hook is simply articulated to release the breaker movable contacts which then abruptly spring to their closed positions under the urgence of the mechanism springs. It is seen that in this arrangement, the circuit breaker has three stable conditions, that is, the circuit breaker may be not only open or closed, but also charged and ready to be closed. Since the breaker operating handle typically cannot distinctively indicate by its position each of these three breaker conditions, it is highly desirable to provide a separate indicator mechanism operable to unambiguously identify whether the breaker is open, closed or charged and ready to close. Commonly assigned U.S. Pat. Nos. 4,042,896 and 3,559,121 disclose motor operated circuit breakers utilizing a hook to hold breaker movable contacts open while the breaker mechanism is charged and indicator apparatus to identify these various conditions assumed by the circuit breaker. Commonly assigned Castonguay, et al application Ser. No. 897,612, filed Apr. 19, 1978 also discloses a mechanism hook and indicator apparatus.

It is an object of the present invention to provide a circuit breaker utilizing a hook to hold breaker movable contacts open against the bias of a manually charged breaker operating mechanism until contact closure is desired.

A further object is to provide circuit breaker apparatus of the above-character, which further includes an indicator for identifying the charged and discharged states of the breaker operating mechanism.

An additional object is to provide circuit breaker apparatus of the above-character wherein the breaker manual operating handle is disabled except when the breaker is open and its operating mechanism discharged.

Another object of the present invention is to provide circuit breaker apparatus of the above character which is relatively inexpensive to manufacture, compact, and reliable in operation.

Other objects of the invention will in part be obvious and in part appear hereinafter.

SUMMARY OF THE INVENTION

In accordance with the present invention, there is provided a circuit breaker including apparatus for controlling the closure of the breaker contacts and for indicating the existing breaker condition. More specifically, the apparatus of the present invention includes latching means for releaseably retaining the breaker movable contacts in their open circuit position, despite the fact that the breaker operating mechanism has been manually articulated to a condition calling for closure of the breaker contacts. That is, the mechanism springs have been charged, and the operating mechanism is in the condition where the mechanism springs would propel the movable contacts into engagement with the breaker stationary contacts, but for the restrain imposed on the movable contacts by the latching means. At the instant breaker closure is desired the latching means is actuated, either manually or electromechanically, to release the movable contacts, and the mechanism springs discharge to close the breaker.

To indicate the existing condition of the circuit breaker, the apparatus of the present invention further includes a pivotally mounted indicator arm carrying at one end a display panel bearing various breaker condition indicia. The other end of the indicator arm is acted upon by the breaker operating mechanism to position the indicator arm so as to identify when the breaker operating mechanism has been manually charged. Also acting on the indicator arm is breaker closing apparatus to reposition the indicator arm coincident with closure of the breaker contacts.

The closing apparatus acts to articulate the hook, releasing the breaker movable contacts for abrupt closure at an appropriate moment in time. Action of the closing apparatus to this end may be initiated manually by depression of a close button or electrically from a remote location by energization of a closing solenoid.

In accordance with an important feature of the present invention, the breaker manual operating handle is automatically decoupled from the breaker operating mechanism at all times except when the operating mechanism is discharged and the breaker contacts are open.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in connection with the accompanying drawings, in which.

Corresponding reference numerals refer to like parts throughout the several views of the drawings.

DETAILED DESCRIPTION

The circuit breaker apparatus of the present invention is particularly, but not exclusively applicable to circuit breakers having toggle operating mechanisms of the type illustrated in commonly assigned U.S. Pat. Nos. 3,343,109 and 3,559,121, the disclosures of which are specifically incorporated herein by reference.

Figure 1:
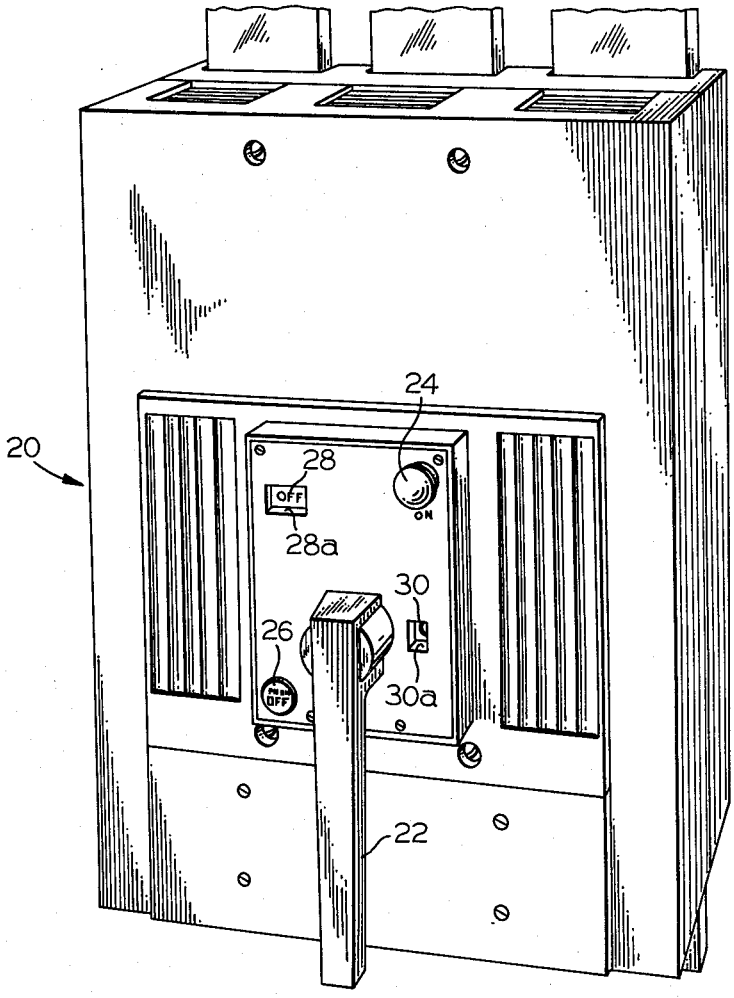
FIG. 1 is a perspective view of an industrial circuit breaker embodying the present invention.

Turning to the drawings, FIG. 1 depicts a three-pole, molded case industrial circuit breaker, generally indicated at 20, embodying the present invention. A crank-type manual operating handle 22 is utilized to charge the breaker operating mechanism preparatory to closure of its contacts as initiated by depression of a close push button 24. Opening of the breaker contacts is effected by depression of an open or off push-button 26. Indicia 28, viewable through a window 28*a* in the breaker cover, identifies whether the breaker contacts are open (OFF) or closed (ON). Indicia 30, viewable through a second cover window 30*a* identifies whether or not the breaker operating mechanism has been charged by the operating handle 22 preparatory to contact closure as initiated by depression of close push-button 24 or, as will be seen, by a closing solenoid.

Figure 2:
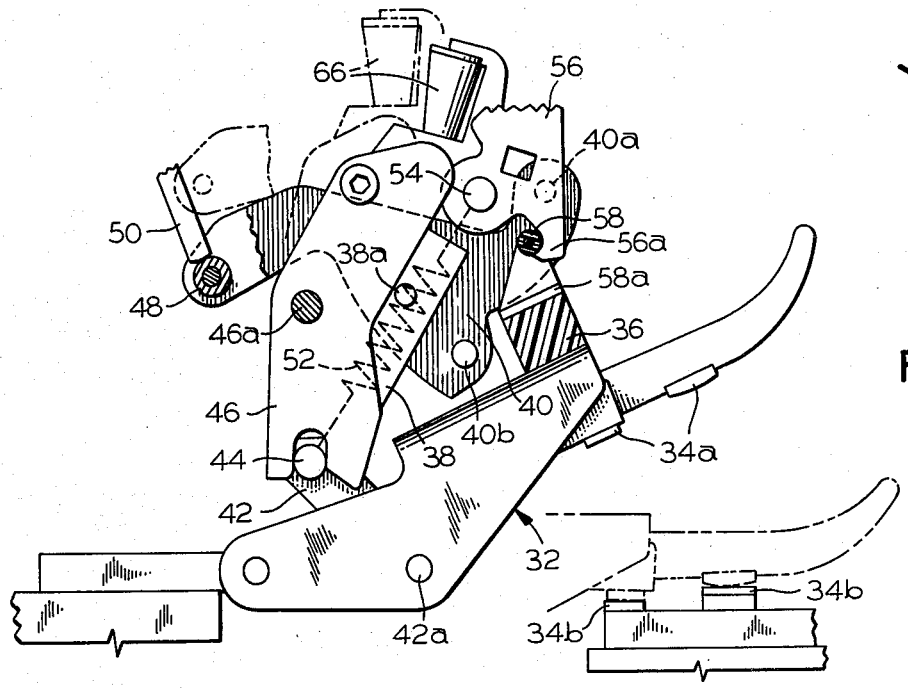
FIG. 2 is a simplified side elevational view of the operating mechanism utilized in the circuit breaker of FIG. 1.

FIG. 2 shows the basic construction of the toggle-type operating mechanism utilized in circuit breaker 20. A detail disclosure of this operating mechanism may be found in the above-noted patents, U.S. Pat. Nos. 3,343,109 and 3,559,121. A movable contact assembly, generally indicated at 32, is pivotally mounted in each breaker pole for movement between an open circuit position, seen in solid line, and a phantom line, closed circuit position with movable contacts 34*a* in engaging relation with corresponding stationary contacts 34*b*. A cross bar 36 gangs the movable contact assemblies together for concerted movement. An upper toggle link 38, pivotally connected at 38*a* to a cradle 40, and a lower link 42, pivotally connected at 42*a* to the center pole movable contact assembly 32, are pivotally interconnected by a knee pin 44. A reset lever 46, pivotally mounted intermediate its ends at 46*a*, is bifurcated at its lower end to accommodate engagement with knee pin 44. Cradle 40, pivotally mounted at 40*a*, carries at one end a roller 48 which is swung into engaging relation with a latch 50 as reset lever 46 is articulated to collapse the toggle links and in the process charge mechanism springs 52 anchored at their ends between knee pin 44 and pin 54. When the mechanism springs become fully charged, the reset lever 46 would pivot about point 46*a*, and the toggle links would straighten under the urgence of the mechanism springs to drive the movable contact assemblies 32 to their closed circuit positions but for the presence of a hook lever 56 pivotally mounted on pin 54 and having a hooked end 56*a* engaging a roller 58 mounted by a bracket 58*a*, secured to crossbar 36. When contact closure is desired, hook 56 is pivoted in the counter clockwise direction, thereby releasing the movable contact assemblies to be driven to their closed circuit positions by the mechanism springs acting to straighten the toggle links. A pin 40*b*, carried by cradle 40 prevents the mechanism springs from pulling the toggle links beyond their fully straightened condition, all as described in the above-noted patents.

To effect opening of the breaker contacts, latch 50 is disengaged from roller 48, either intentionally by depression of push-button 26 (FIG. 1) or automatically in response to an overcurrent condition, thereby releasing cradle 40. The mechanisms springs pull the cradle 40 and contact assemblies 32 upwardly as a unit. Since counter clockwise pivotal movement of reset lever 46 is precluded, the cam surface at its lower end forces the toggle links to collapse to the left as seen in FIG. 2, causing the movable contact assemblies 32 to be abruptly swung upwardly to their open circuit positions.

Figure 3:
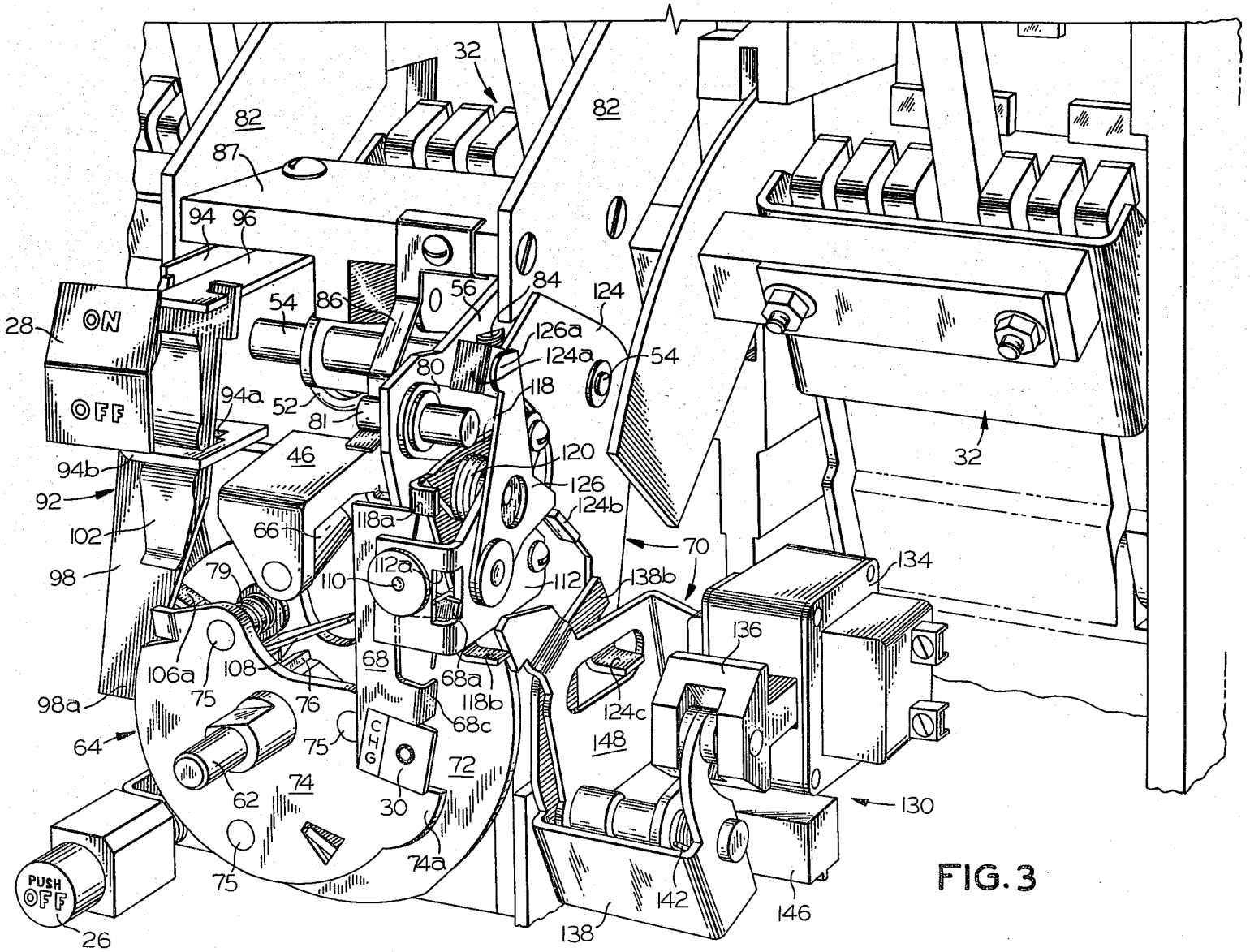
FIG. 3 is a perspective view partially broken away, of the circuit breaker of FIG. 1 with its cover removed.

Turning to FIG. 3, handle 22 seen in FIG. 1 is keyed on a shaft 62 of a charging mechanism, generally indicated at 64. This charging mechanism acts upon a roller 66 carried at the upper end of reset lever 46 (FIG. 2) to motivate pivotal movement of the latter pursuant to charging the mechanism springs 52. Charging mechanism 64 also acts on a pivotal indicator arm 68 bearing indicia 30 (FIG. 1) to expose in cover window 30*a* the appropriate indication as to the condition of the mechanism springs 52. Arm 68, in turn, controls a closing mechanism, generally indicated at 70, in acting on hook 56 pursuant to releasing movable contact assemblies 32 for closure.

Figure 4:
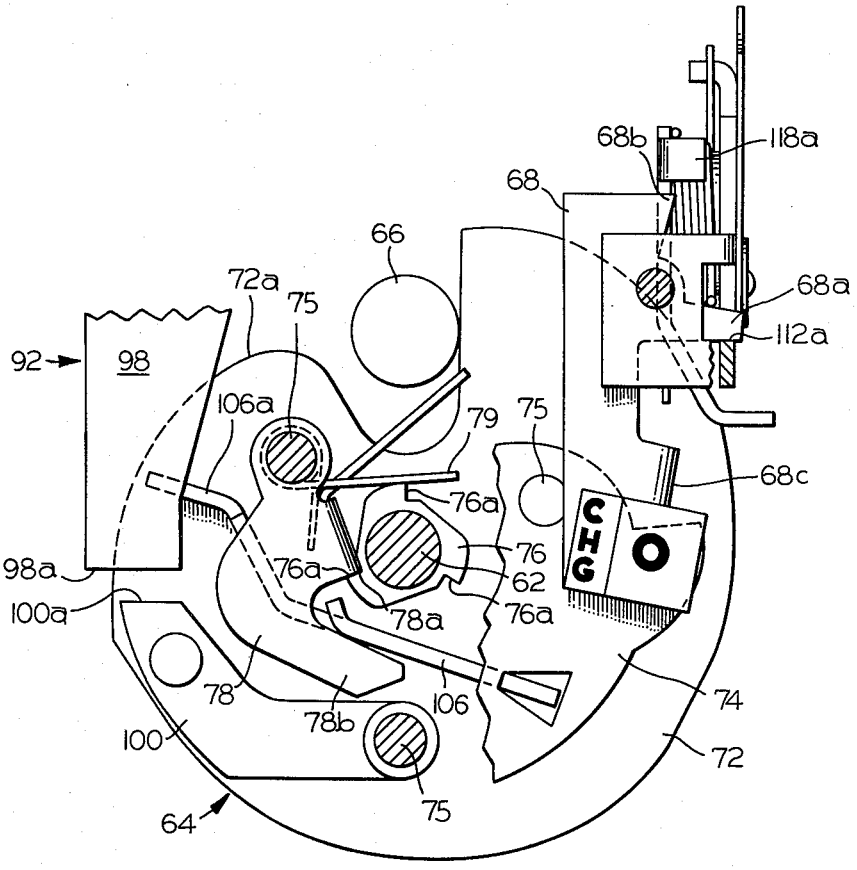
FIG. 4 is a fragmentary plan view of the manual charging mechanism of FIG. 3 in its condition at the start of a charging cycle.
Figure 5:
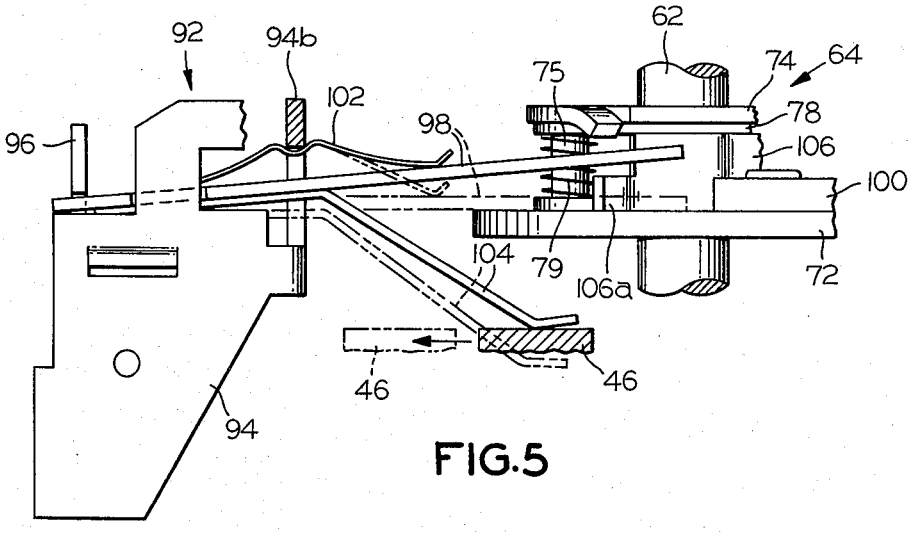
FIG. 5 is a fragmentary side elevational view of the charging mechanism of FIG. 3.
Figure 6:
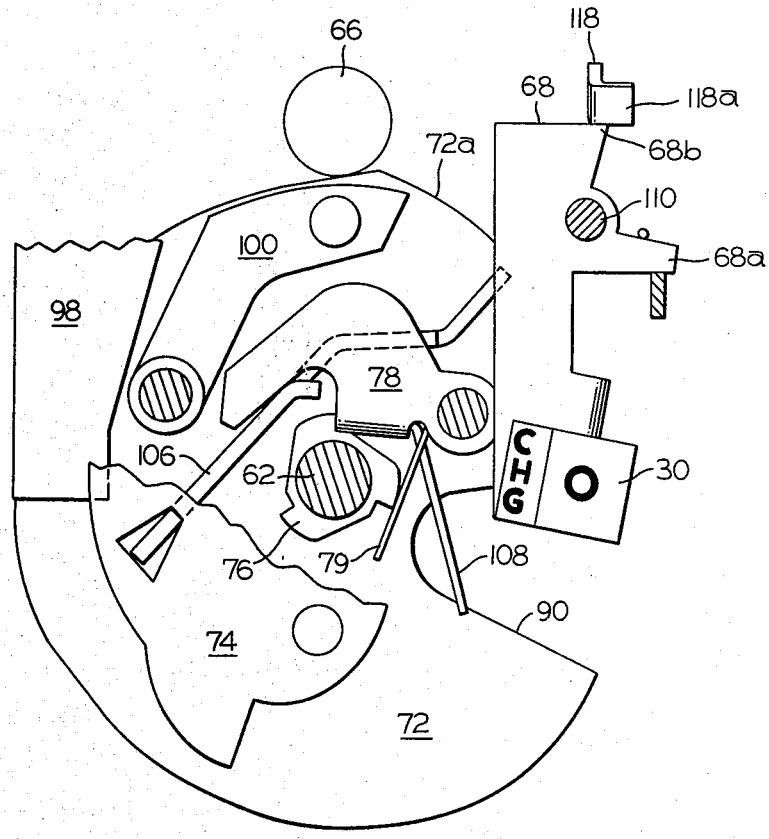
FIG. 6 is a fragmentary plan view of the charging mechanism of FIG. 3 in its condition during a charging cycle.
Figure 7:
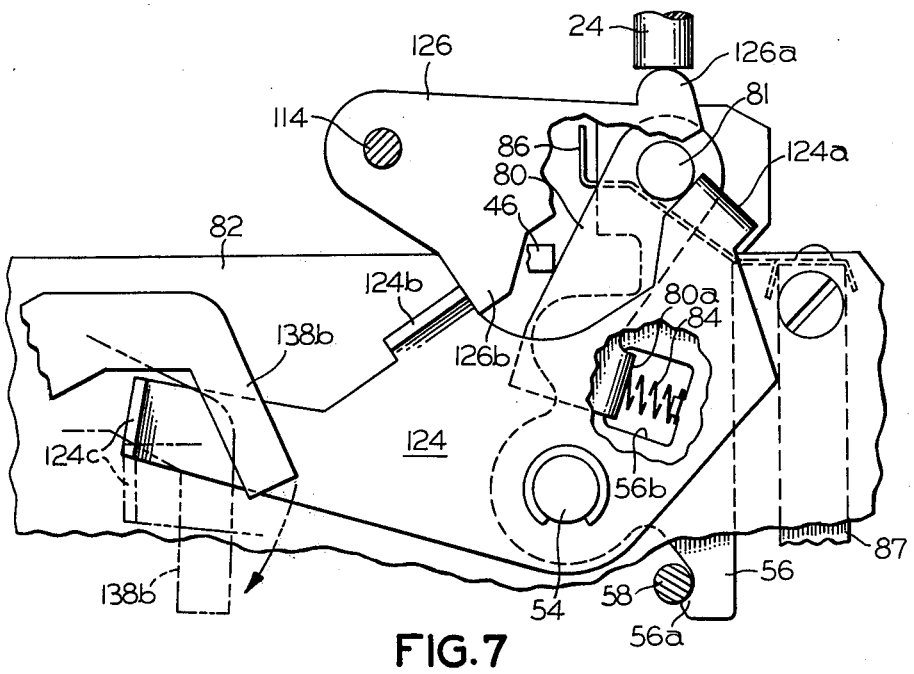
FIG. 7 is a fragmentary side elevational view, partially broken away, of a portion of the circuit breaker closing mechanism of FIG. 3.
Figure 8:
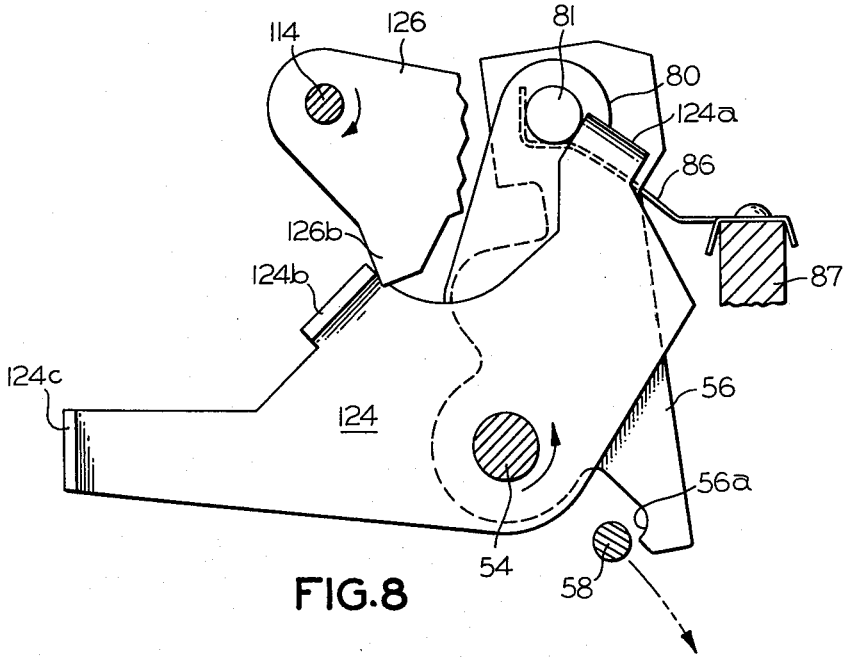
FIG. 8 is a simplified, fragmentary side elevational view, partially broken away, of the closing mechanism of FIG. 7 in its breaker closure enabling condition.

Referring jointly to FIG. 3, 4 and 5, charging mechanism 64 includes a lower cam 72 and an upper cam 74, both journalled on shaft 62 and secured in parallel relation by posts 75. Keyed on shaft 62 intermediate cams 72 and 74 is a ratchet 76 having three, equally angularly spaced teeth 76*a*. A pawl 78 is pivotally mounted on one of the posts 75 and is biased by a torsion spring 79 to engage its tip 78*a* with ratchet 76. It is seen that when handle 22 is cranked to rotate shaft 62 in the clockwise direction seen in FIG. 4, cams 72 and 74 are rotated as a unit also in the clockwise direction. In the process, the edge 72*a* of cam 72 picks up roller 66 mounted atop reset lever 46, camming the upper end of the reset lever upwardly as viewed in FIG. 4. This camming action produces clockwise pivotal movement of reset lever 46, as viewed in FIG. 2, resulting in progressive charging of the mechanism springs 52. After the first 120 degree crank of the handle, the charging mechanism will have been rotated through a corresponding angle in the clockwise direction to its position seen in FIG. 6. With the second full crank of the handle, the charging mechanism is rotated through a second 120 degree angle in the clockwise direction. During the third and final full crank of the handle, the camming of reset lever 46 swings its upper end into engagement with a lever 80 pivotally mounted on a post 81 carried by the upper end of hook 56, as seen in FIG. 7. The hook, as noted in FIG. 2, is pivotally mounted on shaft 54 supported by the breaker mechanism frame 82 (FIG. 3). The lower end of lever 80 is provided with a laterally turned tab 80*a* extending through an aperture 56*b* in the hook. A compression spring 84 is captured in aperture 56*b* to provide a resilient coupling between lever 80 and the hook. It is seen from FIG. 7 that when lever 80 is pivoted in the counter clockwise direction by reset lever 46, this motion is communicated to hook 56 by spring 84. The hook is thus pivoted in the clockwise direction, swinging its hooked lower end 56*a* into engagement with roller 58 to hold the movable contact assemblies 32 in their open circuit positions. A detent spring 86, mounted to a frame supported block 87, acts on pin 81 to hold hook 56 in either its set position of FIG. 7 or its unhooked position by FIG. 8.

Figure 9:
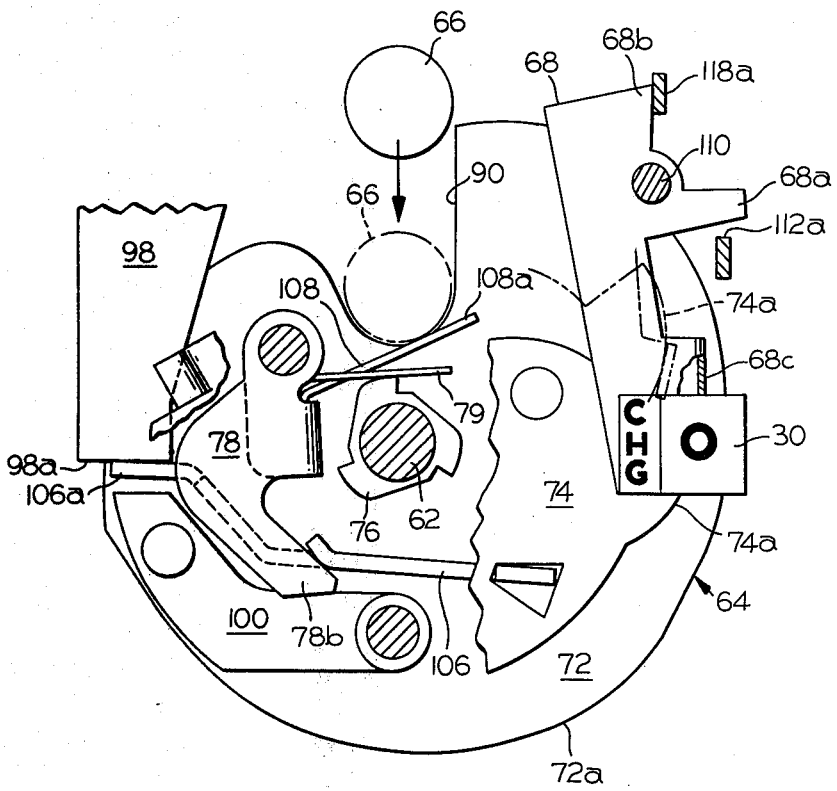
FIG. 9 is a fragmentary plan view of the charging mechanism of FIG. 3 in its condition at the conclusion of a charging cycle.

Turning to FIG. 9, at the conclusion of the third crank of the handle, the charging mechanism 64 will arrive at the position shown, with roller 66 atop reset lever 46 confronting a notch 90 formed in cam 72. With hook 56 set to withstand the contact closure force of the fully charged mechanism springs, roller 66 is held in its solid line position of FIG. 9. To mitigate the impacting stress created as roller 66 rolls off the edge 72*a* of cam 72 into confronting relation with notch 90, the trailing end of this camming edge is made to fall off slightly. When the roller reaches this cam edge trailing end, the charged mechanism springs, in acting on the reset lever, actually drive cam 72 in the clockwise direction. This is particularly so as the roller rolls off the cam edge 72*a* into notch 90. To prevent excessive clockwise rotation of cam 72, as driven by reset lever 46, tending to swing notch 90 beyond its position of alignment with roller 66, a cam stop assembly, generally indicated 92 in FIG. 3, 4 and 5, is provided. This cam stop assembly includes a bracket 94 secured to the breaker frame 82 and in turn mounting a stiff, buffer leaf spring 96 positioned in impact shock absorbing engagement with one end of an elongated, rigid cam stop member 98. This cam stop member extends through an opening 94*a* in an upright extension 94*b* of bracket 94 to present its blunt other end 98*a* in intercepting relation with an abutment 100 fixedly secured to the upper surface of cam 72. A leaf spring 102 positioned in bracket opening 94*a* biases cam stop member 98 downwardly so that its free end portion rides on the upper surface of cam 72 while roller 66 is engaging camming edge 72*a* during the concluding, third crank of handle 22 during a charging cycle. Thus, when roller 66 reaches the trailing end of camming edge 72*a*, the blunt end 98*a* of the cam stop member is in position to engage the blunt end 100*a* of abutment 100 to arrest the clockwise movement of cam 72, as driven by mechanism springs 52 via reset lever 46, at the appropriate angular position with roller 66 aligned with notch 90.

To enable the initiation of a charging cycle after the breaker has been tripped open by depression of push button 26 (FIG. 1) to effect disengagement of latch 50 from cradle latch roller 48 (FIG. 2), an arm 104, seen in FIG. 5, is secured at one end to the underside of cam stop member 98 to dispose its free end in position to sense the position of reset lever 46. During the concluding portion of each charging cycle, the upper end of reset lever 46 is in its phantom line position of FIG. 5 in removed relation with the free end of arm 104. Thus spring 102 is effective in biasing cam stop member 98 downwardly into engagement with the upper surface of cam 72, readying its blunt end 98*a* to inhibit excessive rotation of cam 72 as roller 66 rolls off cam edge 72*a*. When the breaker is in its tripped open condition represented by the position of roller 66 in FIG. 4 and its closed condition represented by the phantom position of roller 66 in FIG. 9, the upper end of reset lever 46 is positioned to engage the free end of arm 104, causing cam stop member 98 to be elevated, as seen in solid line in FIG. 5. It is thus seen that the blunt end 98*a* of the cam stop member is elevated above abutment 100 so as not to interfer with clockwise rotation of cam 72 as a charging cycle is initiated.

As an important feature of the present invention, handle 22 is decoupled from charging mechanism 64 at all times except when a charging cycle is called for. Thus, handle operation is rendered foolproof. To this end, pawl 78, as seen in FIGS. 4, 6 and 9, is provided with an extended finger portion 78*b* disposed in engagement with a pawl release lever 106 pivotally mounted at one end between cams 72 and 74. The free end 106*a* of this lever is in turn positioned to be picked up by the blunt end 98*a* of cam stop member 98 and pivoted into engagement with the blunt end 100*a* of abutment 100. It is thus seen that the free end of lever 106*a* is pinned between abutment 100 and cam stop member 98 as the latter acts to arrest clockwise rotation of cam 72 at the conclusion of a charging cycle. It is seen from FIG. 9 that this pivotal movement of lever 106 picks up finger 78*b* to pivot pawl 78 out of engagement with ratchet 76. Thus, handle 22 is decoupled from charging mechanism 64 when the breaker is in its open and charged condition.

To decouple the handle from the charging mechanism when the breaker is closed, pawl release arm 108, also seen in FIGS. 4, 6 and 9, is secured at one end to pawl 78 with its free end 108*a* extending across the bottom portion of notch 90 in cam 72. When the breaker is closed, roller 66 springs to its phantom position of FIG. 9 seated in the bottom of notch 90, in the process picking up arm 108 to pivot pawl 78 out of engagement with ratchet 76. The provision of pawl release arm 108 is made necessary due to the situation that when the breaker is closed, reset lever 46 is in position to elevate cam stop member 98 (FIG. 5), thereby clearing the free end 106*a* of pawl release lever 106. Consequently, the pawl release effectiveness of lever 106 is cancelled.

As previously noted, charge indicator arm 68 is selectively positioned by the charging mechanism 64, specifically upper cam 74 thereof. This indicator arm is pivotally mounted by a pin 110 carried by a bracket 112 secured to the breaker mechanism frame, as best seen in FIG. 3. A torsion spring 113, seen in FIG. 10, mounted by a pin 114 secured to bracket 112 biases indicator arm 68 toward a clockwise-most position (FIG. 3) determined by the engagement of an indicator arm carried tab 68*a* with an edge of an opening 112*a* formed in bracket 112. In this clockwise-most indicator arm position, the portion of indicia 30 bearing an "O" is registered with cover window 30*a* to indentify that the breaker operating mechanism is uncharged.

Figure 11:
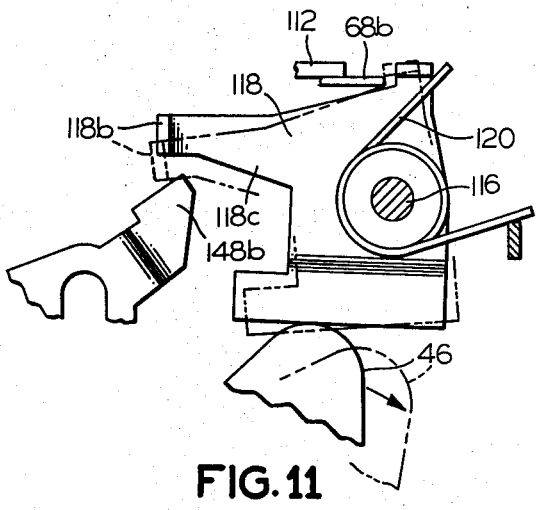
FIG. 11 is a fragmentary side elevational view of a portion of the closing mechanism of FIG. 7 seen in its breaker uncharged condition.
Figure 12:
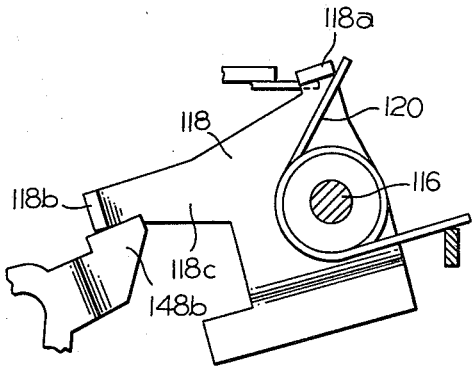
FIG. 12 is a fragmentary side elevational view of that portion of the closing mechanism of FIG. 11 seen in its breaker charged condition.

Also mounted by bracket 112 for pivotal movement on a pin 116 is an interlock lever 118 (FIGS. 3 and 11). Pin 116 also carries a torsion spring 120 acting to bias interlock lever 118 to a counter clockwise-most position determined by the engagement of an upper, laterally turned tab 118*a* of the interlock lever with bracket 112, as seen in FIG. 12. When indicator arm 68 is in its uncharged indicating position (FIGS. 3, 4 and 6), a rear corner 68*b* thereof is in position to engage tab 118*a* and hold interlock lever 118 in the clockwise-most solid line position seen in FIG. 11. A downwardly turned tab 68*c* (FIGS. 3 and 9) is carried by indicator arm 68 in position to be engaged by a lobe 74*a*, formed on the edge of upper cam 74, during the concluding portion of a charging cycle when cam 72 is being driven in the clockwise direction by reset lever roller 66. It is during this time that the charging cycle, in effect, is completed automatically, without regard to handle cranking. Also during this time, lobe 74*a* engages tab 78*c* to pivot indicator arm 68 in the counter clockwise direction. This action swings the rear edge 68*b* of the indicator arm out of engagement with tab 118*a* of interlock lever 118, allowing the latter to pivot to its counter clockwise-most position of FIG. 12 under the urgence of spring 120. Tab 118*a*, then abutting bracket 112, assumes a position of interference with corner 68*b* of indicator arm 68 as seen in FIG. 9, thereby holding the latter in its more counter clockwise position induced by cam lobe 74*a* to display that portion of indicia 30 bearing the identification "CHG" in cover window 30*a*. This signifies to the operator that the breaker mechanism is indeed charged and ready for closure of the breaker contacts.

When the breaker is closed or tripped open, the upper end of reset lever 46, as seen in FIG. 11, swings up into engagement with the lower edge of interlock lever 118, pivoting the interlock lever clockwise. Its tab 118*a* is swung clear of the rear corner 68*b* of indicator arm 68, allowing the latter to pivot clockwise (FIG. 4 and 6) under the urgence of spring 113 to its uncharged indicating position. The corner 68*b* of indicator arm 68 then holds interlock lever 118 in its more clockwise, solid line position of FIG. 11.

Figure 10:
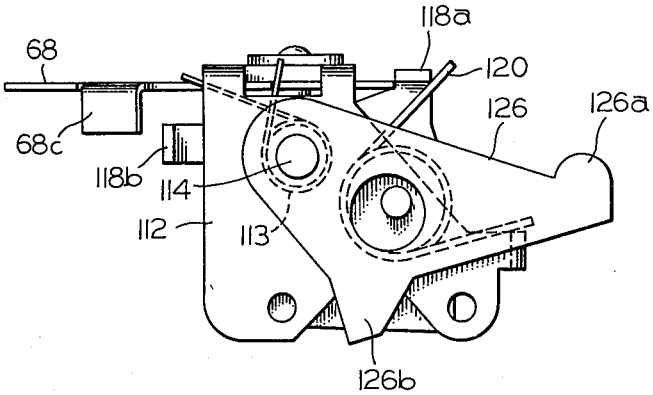
FIG. 10 is a side elevational view of an additional portion of the closing mechanism of FIG. 7.

Returning to FIGS. 7 and 8, an actuating lever 124 is pivotally mounted on shaft 54 and is provided at its upper end with a laterally bent tab 124*a* disposed in engagable relation with pin 81 mounted to the upper end of hook 56. It is thus seen that when actuating lever 124 is pivoted in the counter clockwise direction, its tab 124*a* picks up pin 81 to pivot hook 56 in the counter clockwise direction and release the contact assemblies 32 for closure. To accommodate manually initiated breaker closure via depression of close pushbutton 24 (FIG. 1), a lever 126 is pivotally mounted on pin 114 carried by bracket 112 (FIG. 10). The free end 126*a* of this lever is positioned to be engaged by pushbutton 24, such that its depression induces clockwise pivotal lever motion. In the process a finger extension 126*b* of lever 126 picks up a second laterally turned tab 124*b* of actuating lever 124, thereby pivoting the latter into hook releasing engagement with hook 56.

Figure 13:
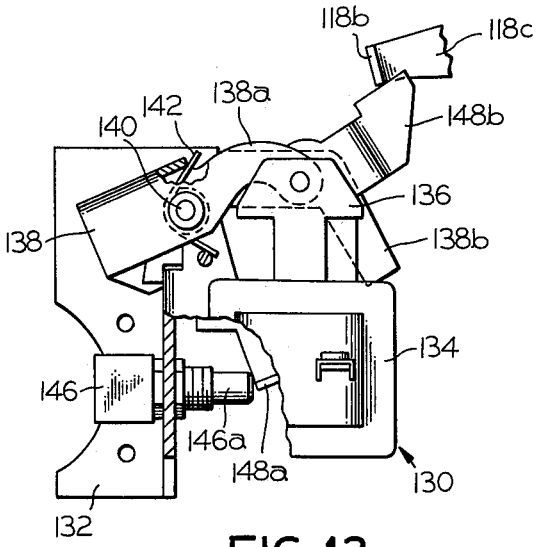
FIG. 13 is a fragmentary side elevational view of the closing solenoid assembly portion of the closing mechanism of FIG. 3 seen in its circuit breaker uncharged condition.
Figure 14:
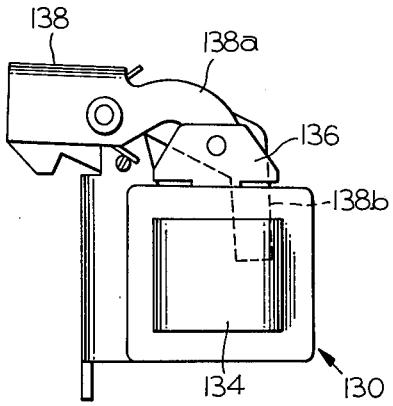
FIG. 14 is a fragmentary side elevational view of a portion of the closing solenoid assembly of FIG. 13 seen in its breaker closure initiating condition.

To accommodate electrically initiated closure of the breaker, possibly from a remote location, a closing solenoid assembly, generally indicated at 130 in FIGS. 3, 13 and 14, is provided. This assembly includes a bracket 132 secured to the breaker frame and in turn mounting a closing solenoid 134. The plunger 136 thereof is pinned to one arm 138*a* of a compound lever 138 pivotally mounted on a shaft 140 carried by bracket 132. A torsion spring 142 acts on lever 138 to bias plunger 136 to its restricted position. A second arm 138*b* of lever 138 is disposed of intercepting relation with a third laterally turned tab 124*c* of actuating lever 124 (FIG. 7). Thus, when solenoid 134 is electrically energized, plunger 136 is pulled in, causing pivotal movement of lever 138 (FIG. 14). Arm 138*b* picks up tab 124*c*, causing actuating lever 124 to be pivoted into hook releasing engagement with pin 81 of hook 56. Pin 58 (FIGS. 2 and 7) is thus released, and the breaker contacts close.

Figure 15:
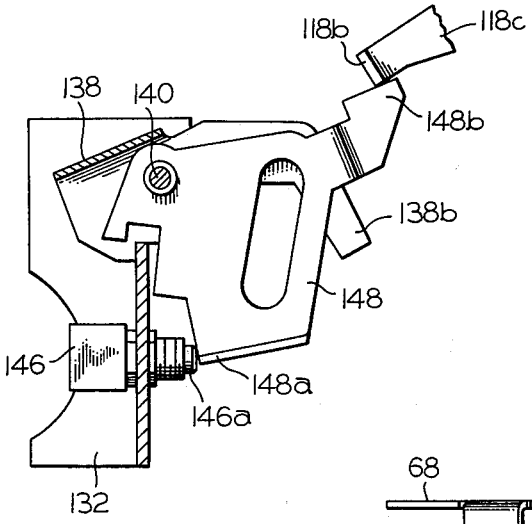
FIG. 15 is a fragmentary side elevational view of a portion of the closing solenoid assembly of FIG. 13 seen in its breaker charged condition.

To prevent closing solenoid energization at all times except when the breaker is open and charged, ready to be closed, the solenoid energization circuit is wired through a lock out switch 146 carried by bracket 132. A switch actuating lever 148, best seen in FIG. 15, is pivotally mounted on shaft 140 and includes a laterally turned flange 148*a* positioned in engagable relation with the actuating plunger 146*a* of lockout switch 146. This switch actuating lever also carries a finger 148*b* for disposition in intercepting relation with a laterally turned tab 118*b* carried at the end of an extended finger portion 118*c* of interlock lever 118 seen in FIGS. 11 and 12.

As previously described, interlock lever 118 is held in its more clockwise solid line position of FIG. 11 by corner 68*b* of indicator arm 68 so long as the latter is in its clockwise-most position of FIG. 6, i.e. until the charging cycle has been completed. Flange 148*a* of actuating lever 148 is thus left in nonactuating engagement with switch plunger 146*a* (FIG. 13), leaving switch 146 open to lock out the closing solenoid energization circuit. When indicator arm 68 is cammed to its breaker charged indicating position by lobe 74*a* of cam 74, interlock lever 118 is released for counter clockwise pivotal movement under the urgence of torsion spring 120. In the process, tab 118*b* picks up finger 148*b*, and actuating lever 148 is pivoted to swing its flange 148*a* into switch actuating engagement plunger 146*a* (FIG. 15). Switch 146 is thus closed to arm the closing solenoid energization circuit. When the breaker is eventually closed, interlock lever 118 is reset by the reset lever 46 as prevously described, and actuating lever 148 is returned to its quiescent position by the internal switch plunger spring (not shown). The closing solenoid energization circuit is thus disarmed until the breaker operating mechanism is recharged.

It will thus be seen that the objects set forth, among these made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. An industrial molded case circuit breaker comprising, in combination:

A. a rotary operating handle;

B. a spring powered breaker contact operating mechanism capable of assuming a discharged condition, a charged condition, and a contact closed condition;

C. a charging mechanism to which said handle is drivingly coupled;

D. a reset operator mounted for movement between a discharged position, a charged position and a contact closed position, said reset operator coupled with said operating mechanism for movement thereby from its charged position to its contact closed position to its discharged position as said operating mechanism goes from its charged condition to its contact closed condition to its discharged condition, said reset operator being engaged by said charging mechanism during a charging cycle for motivation by said handle from its discharged position to its charged position to in turn forcibly drive said operating mechanism from its discharged condition to its charged condition;

E. a hook engagably actuated by said reset operator while approaching its charged position near the conclusion of a charging cycle to latchably engage and detain said operating mechanism in its charged condition and said reset operator in its charged position;

F. a closing mechanism operable to articulate said hook out of engagement with said operating mechanism, whereby said operating mechanism springs from its charged condition to its contact closed condition and said reset operator is moved from its charged position to its contact closed position; and G. means included in said charging mechanism and engagably actuated by said reset operator in both its charged and contact closed positions to automatically decouple said handle from said charging mechanism, upon tripping of said operating mechanism to convert same from its contact closed condition to its discharged condition, said reset operator, in assuming its discharged position, disengages said automatic decoupling means to permit recoupling of said handle with said charging mechanism.

2. The industrial molded case circuit breaker defined in claim 1, which further comprises indicator apparatus including an indicating member actuated from a discharged identifying position to a charged identifying position by said charging mechanism at the conclusion of a charging cycle, said discharged and charged identifying positions of said member being viewable through an opening in the circuit breaker case.

3. The industrial molded case circuit breaker defined in claim 2, wherein said indicating member is spring biased to its discharged identifying position, said indicator apparatus further including an interlock member spring biased toward an actuated position from a quiescent position, said indicating member, while in its discharged identifying position, engagably detaining said interlock member in its quiescent position, said indicating member, upon movement to its charged identifying position, disengaging said interlock member which springs to its actuated position to engagably detain said indicating member in its charged identifying position, said interlock member being forcibly returned to its quiescent position by said reset operator in assuming its contact closed position to enable said indicating member to spring back to its discharged identifying position.

4. The industrial molded case circuit breaker defined in claim 3, wherein said closing mechanism includes a closing solenoid having a normally open arming switch connected in its energization circuit, said interlock member, in assuming its actuated position, initiating actuation of said switch to its closed condition.

5. The industrial molded case circuit breaker defined in claim 3, wherein said charging mechanism further includes a first cam acting on said reset operator in propelling same from its discharged position to its charged position during a charging cycle and a second cam actuating said indicating member from its discharged identifying position to its charged identifying position, said cams ganged together for concerted driven rotation by said handle.

6. The industrial molded case circuit breaker defined in claim 1, wherein said charging mechanism includes a ratchet and pawl drive coupling with said handle, said automatic decoupling means acting under the control of said reset operator, in assuming its charged and contact closed positions, in effecting movement of said pawl out of engagement with said ratchet against the bias of a pawl return spring, said automatic decoupling means controlled by said reset operator, while in its discharged position, to release said pawl, whereby said return spring swings said pawl back into engagement with said ratchet.

7. The industrial molded case circuit breaker defined in claim 6, wherein said charging mechanism further includes a stop member controllably positioned by said reset operator as it approaches its charged position during the conclusion of a charging cycle to arrest further motion of said charging mechanism, whereby to coordinate the position of said charging mechanism with said charged position of said reset operator.

8. The industrial molded case circuit breaker defined in claim 7, wherein said stop, incident with arresting motion of said charging mechanism, actuates said decoupling means to move said pawl out of engagement with said ratchet, and said reset operator, incident with assuming its contact closed position, actuates said decoupling means to maintain said pawl in disengaged relation with said ratchet.

9. The industrial molded case circuit breaker defined in claim 8, which further comprises indicator apparatus including an indicating member actuated from a discharged identifying position to a charged identifying position by said charging mechanism at the conclusion of a charging cycle, said discharged and charged identifying positions of said member being viewable through an opening in the circuit breaker case.

10. The industrial molded case circuit breaker defined in claim 9, wherein said indicating member is spring biased to its discharged identifying position, said indicator apparatus further including an interlock member spring biased toward an actuated position from a quiescent position, said indicating member, while in its discharged identifying position, engagably detaining said interlock member in its quiescent position, said indicating member, upon movement to its charged identifying position, disengaging said interlock member which springs to its actuated position to engagably detain said indicating member in its charged identifying position, said interlock member being forcibly returned to its quiescent position by said reset operator in assuming its contact closed position to enable said indicating member to spring back to its discharged identifying position.

11. The industrial molded case circuit breaker defined in claim 10, wherein said closing mechanism includes a closing solenoid having a normally open arming switch connected in its energization circuit, said interlock member, in assuming its actuated position, initiating actuation of said switch to its closed condition.

12. The industrial molded case circuit breaker defined in claim 10, wherein said charging mechanism further includes a first cam acting on said reset operator in propelling same from its discharged position to its charged position during a charging cycle and a second cam actuating said indicating member from its discharged identifying position to its charged identifying position, said cams ganged together for concerted driven rotation of said handle.

* * * * *